US007439280B2

(12) United States Patent
Lu et al.

(10) Patent No.: US 7,439,280 B2
(45) Date of Patent: Oct. 21, 2008

(54) LIGNOCELLULOSIC COMPOSITE MATERIAL AND METHOD FOR PREPARING THE SAME

(75) Inventors: Limei Lu, Canton, MI (US); Keith A. Holmes, Cary, NC (US); Clark D. Klein, Pittsboro, NC (US); Donald C. Mente, Grosse Ile, MI (US)

(73) Assignee: BASF Corporation, Florham Park, NJ (US)

( * ) Notice: Subject to any disclaimer, the term of this patent is extended or adjusted under 35 U.S.C. 154(b) by 831 days.

(21) Appl. No.: 10/818,961

(22) Filed: Apr. 6, 2004

(65) Prior Publication Data

US 2005/0221078 A1 Oct. 6, 2005

(51) Int. Cl.
*C08L 97/02* (2006.01)

(52) U.S. Cl. ..... 523/122; 524/14

(58) Field of Classification Search ..... None
See application file for complete search history.

(56) References Cited

U.S. PATENT DOCUMENTS

| | | | | |
|---|---|---|---|---|
| 3,870,665 | A * | 3/1975 | Diehr et al. | 524/9 |
| 5,837,290 | A | 11/1998 | Hasslin | |
| 6,187,234 | B1 * | 2/2001 | Bonomo et al. | 264/83 |
| 6,322,803 | B1 | 11/2001 | Van Voris et al. | |
| 6,368,529 | B1 * | 4/2002 | Lloyd et al. | 264/109 |
| 6,673,836 | B2 | 1/2004 | Ramos | |
| 2003/0009043 | A1 * | 1/2003 | Partridge et al. | 556/54 |
| 2003/0026942 | A1 * | 2/2003 | Hejna et al. | 428/107 |
| 2003/0049293 | A1 | 3/2003 | Jobic | |
| 2003/0224179 | A1 * | 12/2003 | Skinner et al. | 428/425.1 |
| 2006/0252847 | A1 * | 11/2006 | Hayward et al. | 523/122 |

FOREIGN PATENT DOCUMENTS

| | | | |
|---|---|---|---|
| CA | 2273545 | | 6/1999 |
| DE | 19548872 | A1 | 7/1997 |
| DE | 19548873 | A1 | 7/1997 |
| DE | 19548874 | A1 | 7/1997 |
| JP | H11-49618 | | 2/1999 |
| JP | H11-207706 | | 8/1999 |
| WO | WO 2004/054766 | A1 * | 7/2004 |

OTHER PUBLICATIONS

Publication entitled "Environmental Fate of Fipronil," by Pete Connelly of Environmental Monitoring Branch Department of Pesticide Regulation California Environmental Protection Agency, Dec. 2001.
Book entitled "European Commission DG ENV," author unknown, published by BKH Consulting Engineers, Nov. 10, 2000.
Web page entitled "Fipronil," author unknown, by the national Pesticide Telecommunications Network, Dec. 1997, http://ace.orst.edu/info/nptn.
Web page entitled "Safety Source for Pest Management Beyond Pesticides Least Toxic Service Directory," author unknown, Jan. 25, 2004, www.beyondpesticides.org.
Web page entitled "Fipronil," author unknown, Pesticides News, Jan. 25, 2004, www.pan-uk.org.
Article entitled "Properties of Laboratory-Made Plywood with Fipronil Insecticide Added In the Resin Formulation," by D. Pascal Kamdem, Joe Hope, Jacques Oudenweyer and McKenzie Munro, Forest Products Journal, vol. 52, No. 9, pp. 40-43, Sep. 2001.
Publication entitled "Fipronil insecticides: Novel photochemical desulfinylation with retention of neurotoxicity," author unknown, Proc. Natl. Acad. Sci. USA, vol. 93, pp. 12764-12767, Nov. 1996.
Web page entitled "Fipronil Data Sheet," Jan. 25, 2004, www.alanwood.net.

* cited by examiner

*Primary Examiner*—Mary Lynn F Theisen
(74) *Attorney, Agent, or Firm*—Fernando A. Borrego; Howard & Howard

(57) ABSTRACT

A lignocellulosic composite material and a method for preparing the lignocellulosic composite material are disclosed. The composite material is formed from lignocellulosic particles and a binder resin. The binder resin comprises a polyisocyanate, at least one of insecticide and/or fungicide that are dispersed throughout the polyisocyanate. The insecticide and/or fungicide is also dispersed throughout the lignocellulosic particles. Since the insecticide and/or fungicide is dispersed throughout the composite material, the composite material is insect resistant and is able to withstand insect attacks and prevent fungus growth and decay.

13 Claims, No Drawings

LIGNOCELLULOSIC COMPOSITE MATERIAL AND METHOD FOR PREPARING THE SAME

BACKGROUND OF THE INVENTION

1) Field of the Invention

The subject invention generally relates to a lignocellulosic composite material and a method for preparing the lignocellulosic composite material. The subject invention also generally relates to a binder resin having at least one of an insecticide and a fungicide therein for forming the composite material.

2) Description of Related Art

Composite materials, such as oriented strand board (OSB), medium density fiberboard (MDF), agrifiber board, particle board, flakeboard, and laminated strand board (LVL) are known in the art. Generally, these types of boards are produced by blending or spraying lignocellulosic particles or materials with a binder resin while the lignocellulosic particles are tumbled or agitated in a blender or like apparatus. Lignocellulosic particles generally refer to wood particles as appreciated by those skilled in the art. After blending sufficiently to form a uniform mixture, the particles are formed into a loose mat, which is compressed between heated platens or plates, or by steam injection between the two platens to cure the binder and bond the flakes, strands, strips, pieces, etc., together in densified form. Conventional processes are generally carried out at temperatures of from about 120 to 225° C. in the presence of varying amounts of steam, either purposefully injected into or generated by liberation of entrained moisture from the wood or lignocellulosic particles. These processes also generally require that the moisture content of the lignocellulosic particles be between about 1 and about 20% by weight, before it is blended with the binder resin to produce adequate physical properties of the composite material.

The lignocellulosic particles can be in the form of chips, shavings, strands, wafers, fibers, sawdust, bagasse, straw, wood wool, bamboo and the like, depending upon the type of composite material desired to be formed. When the particles are larger, the boards produced by the process are known in the art under the general term of engineered wood. These engineered woods include panels, plywood, laminated strand lumber, OSB, parallel strand lumber, and laminated veneer lumber. When the lignocellulosic particles are smaller, the boards are known in the art as particleboard and fiber board.

The engineered wood products were developed due to the increasing scarcity of suitably sized tree trunks for cutting lumber. Such products can have advantageous physical properties such as strength and stability. Another advantage of the engineered wood and particle boards is that they can be made from the waste material generated by processing other wood and lignocellulosic materials. This leads to efficiencies and energy savings from recycling processes, and saves landfill space.

Binder resin compositions that have been used in making such composite wood products include phenol formaldehyde resins, urea formaldehyde resins, melamine urea formaldehyde, and isocyanates resins. Isocyanate binders are commercially desirable because they have low water absorption, high adhesive and cohesive strength, flexibility in formulation, versatility with respect to cure temperature and rate, excellent structural properties, the ability to bond with lignocellulosic materials having high water contents, and no additional formaldehyde emissions from resin. The disadvantages associated with the use of isocyanates include difficulty in processing due to their high reactivity, too much adhesion to platens, lack of cold tack, high cost and the need for special storage.

It is known to treat lignocellulosic materials with polymeric diphenylmethane diisocyanate (polymeric MDI or PMDI) to improve the strength of the composite material. Typically, such treatment involves applying the isocyanate to the material and allowing the isocyanate to cure, either by application of heat and pressure or at room temperature. While it is possible to allow the polymeric MDI to cure under ambient conditions, residual isocyanate groups remain on the treated products for weeks or even months in some instances. It is also known, but generally less acceptable from an environmental standpoint, to utilize toluene diisocyanate for such purposes. Isocyanate prepolymers are among the preferred isocyanate materials that have been used in binder compositions to solve various processing problems, particularly adhesion to press platens and high reactivity.

In the past, various solvents have been added to binder resin with the aim of achieving a lower viscosity and better handling properties. After application, the solvent evaporates during the molding process, leaving the bound particles behind. One major disadvantage of prior art solvents is that they cause a reduction in the physical properties of the formed board including a reduction in the internal bond strength of the formed board.

Separately from the formulation of improved lignocellulosic composite materials, it is desirable to prevent insects from damaging the composite materials over time and during normal use. Those skilled in the art of insecticides have developed numerous insecticides that are capable of killing or intoxicating various insects once they are exposed to the insecticide.

While these insecticides have been very commercially successful in the agricultural applications, typical applications have encountered difficulty in applying them in lignocellulosic composite materials. Various methods have been employed to incorporate these insecticides into the wooden structures discussed above and any other wooden article. For example, various prior art methods dissolve an insecticide in a solvent, such as water, and spray the solution onto the wooden structure. The solvent then absorbs into the wood and prevents the insects from damaging the wooden structure. However, one drawback with spraying the solution on wood that is already formed is that over time, the insects will eat away at the wood and eventually get beyond the point where the solution has absorbed. At this point, the wooden structure is vulnerable to subsequent attacks by insects. Another drawback to this method is that any additional water added during formation of the composite material reduces the physical properties of the final composite material. During the pressing stage, steam pressure from any water present in the composite material tends to reduce the physical properties. Therefore, adding additional water would increase the steam pressure and further reduce the physical properties. Additionally, it is typical to dry the wood strands to lower moisture content at the beginning to minimize this effect, but this additional drying costs energy and time.

Other methods, especially used in the formation of plywood, include incorporating a powder insecticide directly into a glue or an adhesive. Plywood, or laminated veneer, is prepared by applying glue to an already formed layer of wood and compressing it together with another layer of wood. The glue, having the insecticide therein, is applied between the layers of the wood and is compressed to form the plywood. However, the insecticide is not present, i.e., dispersed, throughout the wood, since it is only located in the glue between the layers. Therefore, it is possible to have an initial infestation of insects eat through the glue layer exposing the unprotected wood underneath. Subsequent infestations of insects are then able to cause substantial damage because the insecticide has been removed. In this method, the plywood has not been made insect resistant, only the glue is insect resistant.

Still other methods have incorporated the insecticide by encapsulating the insecticide in a polyurethane. It is known that the dispersibility and dissolvability of certain insecticides, such as fipronil, is difficult to achieve in certain substances, such as water. Therefore, encapsulating the insecticide in polyurethane improves the dispersibility of the insecticide. However, the encapsulation restricts the direct contact of the insecticide with the insect and requires the insect, in addition to eating the wood, to eat through the polyurethane prior to reaching the insecticide. Therefore, encapsulating the insecticide is not desirable. Further, the additional steps required to encapsulate the insecticide increase the time and cost of production, which are commercially unacceptable.

Fungicides have also been used to treat lignocellulosic composite materials. Fungicides are substances possessing the power of killing or preventing the growth of fungus. Therefore, the fungicides reduce the likelihood that the composite material will decay as a result of fungus over time. However, the application of the fungicide has been limited in similar circumstances as the insecticides discussed above.

Accordingly, it would be advantageous to provide a lignocellulosic composite material that is insect and fungus resistant and that is capable of withstanding insect attacks over a longer period of time to prevent insect damage to the composite material. The related art methods that only apply the insecticide to the surface of the wood or in the adhesive layers between the wood are subject to subsequent insect attacks after the insecticide layer has been breached. Therefore, it is desirable to produce a lignocellulosic composite material that has the insecticide present in a low dosage and dispersed throughout the composite material for preventing insect attacks.

BRIEF SUMMARY OF THE INVENTION

The subject invention provides a lignocellulosic composite material formed from lignocellulosic particles and a binder resin. The lignocellulosic particles are used in an amount of from about 75 to 99.5 parts by dry weight based on 100 parts by weight of the composite material and the binder resin is used in an amount of from 0.5 to 25 parts by weight based on 100 parts by weight of the composite material. The binder resin comprises a polyisocyanate and at least one of an insecticide and a fungicide. The insecticide and the fungicide are dispersed throughout the polyisocyanate, which is then dispersed throughout the lignocellulosic particles. Since the insecticide and the fungicide are dispersed throughout the composite material, the composite material is insect resistant and/or fungus resistant to withstand a subsequent insect attacks and prevent fungus growth and decay.

The binder resin more specifically includes the polyisocyanate, a polar solvent, and the insecticide that is dissolved in the polar solvent to form an insecticide solution. The polar solvent is capable of dissolving at least 10 grams of the insecticide per one liter of the polar solvent. The insecticide solution is dispersed throughout the polyisocyanate to form the binder resin. Next, a lignocellulosic mixture is formed that comprises the lignocellulosic particles and the binder resin. The lignocellulosic composite material is formed by compressing the lignocellulosic mixture at an elevated temperature and under pressure.

The subject invention provides a lignocellulosic composite material having at least one of the insecticide and the fungicide dispersed throughout the composite material. The resultant composite material is insect and/or fungus resistant. The composite material is able to repel insect attacks and fungus decay throughout the life of the composite material. Since the insecticide is dispersed throughout, an initial infestation of insects is not able to breach an insecticide layer and any subsequent infestations of insects will suffer the same fate as that of the first. Therefore, the lignocellulosic composite material of the present invention enjoys a longer period of life because it is insect resistant.

DETAILED DESCRIPTION OF THE INVENTION

A lignocellulosic composite material and a method for preparing the lignocellulosic composite material are disclosed. The composite material includes lignocellulosic particles and a binder resin. Throughout the present specification and claims, the terms compression molded, compressed, or pressed are intended to refer to the same process whereby the material is formed by either compression molding the material in a mold or by using compression as between a pair of plates from a press. In both procedures, pressure and heat are used to form the material and to set the binder resin.

The lignocellulosic particles can be derived from a variety of sources. They can be derived from wood and from other products such as bagasse, straw, flax residue, nut shells, cereal grain hulls, and mixtures thereof. Non-lignocellulosic materials in flake, fibrous or other particulate form, such as glass fiber, mica, asbestos, rubber, plastics and the like, can be mixed with the lignocellulosic material. The lignocellulosic particles can come from the process of comminuting small logs, industrial wood residue, branches, or rough pulpwood into particles in the form of sawdust, chips, flakes, wafer, strands, medium density fibers (MDF), and the like. They can be prepared from various species of hardwoods and softwoods. The lignocellulosic particles may have a moisture content of from 1 to 15 weight percent. In a further preferred embodiment, the water content is from 3 to 12 weight percent, and most preferably from 4 to 10 weight percent. The water assists in the curing or setting of the binder resin, which is described further below. Even when the lignocellulosic particles are dried, they typically still have a moisture content of from 2 to 15 weight percent.

The lignocellulosic particles can be produced by various conventional techniques. For example, pulpwood grade logs can be converted into flakes in one operation with a conventional roundwood flaker. Alternatively, logs and logging residue can be cut into fingerlings on the order of about 0.5 to 3.5 inches long with a conventional apparatus, and the fingerlings flaked in a conventional ring type flaker. The logs are preferably debarked before flaking.

The dimensions of the lignocellulosic particles are not particularly critical. Flakes commonly have an average length of about 2 to 6 inches, and average width of about 0.25 to 3 inches, and an average thickness of about 0.005 to about 0.05 inches. Strands which are about 1.5 inches wide and 12 inches long can be used to make laminated strand lumber, while strands about 0.12 inches thick and 9.8 inches long can be used to make parallel strand lumber. The lignocellulosic particles can be further milled prior to use in the process of the invention, if such is desired to produce a size more suitable for producing the desired article. For example, hammer, wing beater, and toothed disk mills may be used.

In the subject invention, the lignocellulosic particles are present in an amount of from about 75 to 99.5 parts by dry weight based on 100 parts by weight of the composite material, preferably from about 80 to 99.5 parts by dry weight based on 100 parts by weight of the composite material, and most preferably 85 to 99.5 parts by dry weight based on 100 parts by weight of the composite material.

The binder resin includes a polyisocyanate and at least one of an insecticide and a fungicide. The binder resin is present in an amount of from 0.5 to 25 parts by weight based on 100 parts by weight of the composite material, whereby the remainder is the lignocellulosic particles. However, it is to be appreciated that other additives may be added, such as wax, flame retardant, and the like. In a preferred embodiment, the binder resin is present in an amount of from 0.5 to 20, and more preferably from 1 to 20 parts by weight based on 100 parts by weight of the composite material, and most preferably from 2 to 15 parts by weight based on 100 parts by weight of composite material.

The polyisocyanate that may be used in forming the binder resin includes aliphatic, alicyclic and aromatic polyisocyanates characterized by containing two or more isocyanate groups. Such polyisocyanates include the diisocyanates and higher functionality isocyanates, particularly the aromatic polyisocyanates. Mixtures of polyisocyanates which may be used include, crude mixtures of di- and higher functionality polyisocyanates produced by phosgenation of aniline-formaldehyde condensates or as prepared by the thermal decomposition of the corresponding carbamates dissolved in a suitable solvent, as described in U.S. Pat. Nos. 3,962,302 and 3,919,279, the disclosures of which are incorporated herein by reference, both known as crude diphenylmethane diisocyanate (MDI) or polymeric MDI (PMDI). The polyisocyanate may be an isocyanate-terminated prepolymer made by reacting, under standard conditions, an excess of a polyisocyanate with a polyol which, on a polyisocyanate to polyol basis, may range from about 20:1 to 2:1. The polyols include, for example, polyethylene glycol, polypropylene glycol, diethylene glycol monobutyl ether, ethylene glycol monoethyl ether, triethylene glycol, etc., as well as glycols or polyglycols partially esterified with carboxylic acids including polyester polyols and polyether polyols.

The polyisocyanates or isocyanate-terminated prepolymers may also be used in the form of an aqueous emulsion by mixing such materials with water in the presence of an emulsifying agent. The isocyanate compound may also be a modified isocyanate, such as, carbodiimides, allophanates, isocyanurates, and biurets.

Also illustrative of the di- or polyisocyanates which may be employed are, for example: toluene-2,4- and 2,6-diisocyanates or mixtures thereof; diphenylmethane-4,4'-diisocyanate and diphenylmethane-2,4'-diisocyanate or mixtures of the same, the mixtures preferably containing about 10 parts by weight 2,4'- or higher, making them liquid at room temperature; polymethylene polyphenyl isocyanates; naphthalene-1,5-diisocyanate; 3,3'-dimethyl diphenylmethane-4,4'-diisocyanate; triphenyl-methane triisocyanate; hexamethylene diisocyanate; 3,3'-ditolylene-4,4-diisocyanate; butylene 1,4-diisocyanate; octylene-1,8-diisocyanate; 4-chloro-1,3-phenylene diisocyanate; 1,4-, 1,3-, and 1,2-cyclohexylene diisocyanates; and, in general, the polyisocyanates disclosed in U.S. Pat. No. 3,577,358, the disclosure of which is incorporated herein by reference. Preferred polyisocyanates include polymeric diphenylmethyl diisocyanate and monomeric diphenylmethane diisocyanate being at least one of diphenylmethane-4,4'-diisocyanate, diphenylmethane-2,4'-diisocyanate, and diphenylmethane-2,2'-diisocyanate. Most preferably, the polyisocyanate component is polymeric diphenylmethyl diisocyanate. One example of a preferred polyisocyanate is, but is not limited to, Lupranate® M20 S, commercially available from BASF Corporation.

The polyisocyanate is present in the binder resin in an amount of from about 60 to 99.99 parts by weight based on 100 parts by weight of the binder resin. In a preferred embodiment, the polyisocyanate is present in an amount of from about 80 to 99.9 parts by weight based on 100 parts by weight of the binder resin, and most preferably from about 90 to 99.9 parts by weight based on 100 parts by weight of the binder resin.

Preferably, the insecticide is dissolved in a polar solvent to form an insecticide solution. The insecticide solution is then mixed with the polyisocyanate to form the binder resin with well-dispersed insecticide. It is to be appreciated that the fungicide may also be dissolved in the polar solvent to ensure that it is well dispersed. This mixing process may occur right before applying the resin to the wood substrates, such as using in-line mixing techniques before feeding the resin mixture into the blending equipment. The polar solvent is capable of dissolving at least 10 grams of the insecticide per one liter of the polar solvent.

In order to ensure that a sufficient amount of insecticide is added without adding too much polar solvent, the dissolvability of the insecticide is important. It is desirable to only add a low dosage of the insecticide that is sufficient to repel insect attacks. Therefore, it is important to ensure the low dosage is distributed throughout. If the solvent is capable of dissolving only less than 10 grams, then in order to have enough of the insecticide, more solvent would be needed. This creates the problem that the lignocellulosic composite material will not have sufficient physical properties, such as modulus of elasticity. When the lignocellulosic composite material is formed under elevated temperature, the solvent evaporates from the mixture. If too much solvent in added, the evaporating solvent creates a steam pressure within the forming lignocellulosic composite material and it hinders the physical properties.

It has been determined that certain polar solvents are capable of dissolving at least 10 grams of the insecticide per liter of solvent. For example, it has also been determined that water is not a sufficient polar solvent for certain insecticides, such as Fipronil, because it is capable of only dissolving 2.4 milligrams per liter of water. Generally, these polar solvents that are capable of dissolving at least 10 grams of the insecticide per liter are selected from at least one of an alcohol, a ketone, and an ester. More preferably, the polar solvent is selected from the group of octyl alcohol, isopropyl alcohol, methyl alcohol, acetone, carpryl alcohol, propylene carbonate, gamma-butyrolactone, 3-pentanone, 1-methyl-2-pyrrolidinone, and combinations thereof.

The insecticide is selected from at least one of the following: pyrazole insecticides, pyrrole insecticides, pyrethroid insecticides, amidinohydrazone insecticides, semicarbazone insecticides, and neo-neo-nicotinoid insecticides. In other words, the insecticide may be a pyrazole insecticide or a pyrrole insecticide, etc. The insecticide may also be a mixture or combination of these insecticides. Each of these insecticides attacks the insects in a different manner and is not intended to limit the subject invention. One example of a pyrrole insecticide is, but not limited to, chlorfenapyr. One example of a pyrethroid insecticide, is, but not limited to alphacypermethrin. One example of an amidinohydrazone insecticide, is, but not limited to hydramethylnon. One example of a semicarbazone insecticide, is, but not limited to BAS 320-I. One example of a neo-neo-nicotinoid insecticide is, but not limited to imidacloprid.

The pyrazole insecticide is typically available and used in at least one of a powder form and a granular form prior to being dissolved in the polar solvent. It is preferred that the pyrazole insecticide is an aryl pyrazole compound having the general formula of:

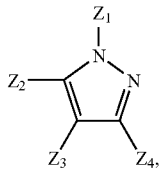

wherein $Z_1$ may be an alkly or an aryl group, $Z_2$ is an amine, an alkyl, or a hydrogen, $Z_3$ is a sulfoxide and haloaklyl, and $Z_4$ is CN or methyl. Further, the aryl pyrazole may open the aromatic pentane ring to form the insecticide. The pyrazole insecticide may be selected from one of fipronil, ethiprole or acetaprole and combinations thereof.

More preferably, the pyrazole insecticide has the general formula of:

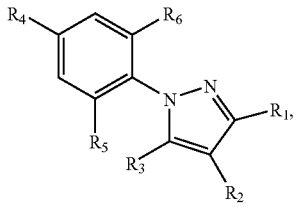

wherein $R_1$ is one of CN and methyl, $R_2$ is $S(O)_nA$, wherein A is a haloaklyl and n is 0, 1, or 2, $R_3$ is one of H, $NH_2$, and alkyl, $R_4$ is an haloaklyl, $R_5$ is a halogen, and $R_6$ is a halogen.

Most preferably, the pyrazole insecticide is fipronil (5-amino-1-(2,6-dichloro-4-(trifluoromethyl)phenyl)-4-((trifluoromethyl)sulfinyl)-1H-pyrazole-3-carbonitrile) having the formula of $C_{12}H_4Cl_2F_6N_4OS$ and the following structure:

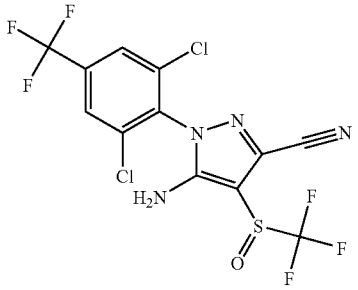

The insecticide is present in an amount of from 0.001 to 10, preferably from 0.001 to 5, and most preferably from 0.001 to 2.5 parts by weight based on 100 parts by weight of the binder resin. The polar solvent is present in an amount of from 0.1 to 20 parts by weight based on 100 parts by weight of the binder resin. However, it is to be appreciated that the amount of the polar solvent depends upon the dissolvability of the insecticide in the polar solvent. Therefore, more of the polar solvent will be required if it can dissolve 10 grams of the insecticide per liter than if the polar solvent can dissolve 600 grams per liter.

Typical examples of fungicides that may be utilized with the subject invention include, but are not limited to, triazoles, benzimidazoles, morpholines, dicarboxamides or strobilurines. The fungicide may be added directly to the polyisocyanate or may be dissolved in the polar solvent as discussed above. Dissolving the fungicide in the polar solvent ensures the fungicide is well dispersed throughout the composite material. The fungicide is present in an amount of from 0.001 to 10, preferably from 0.001 to 5, and most preferably from 0.001 to 2.5 parts by weight based on 100 parts by weight of the binder resin. The method of forming the lignocellulosic composite material includes the steps of dispersing at least one of the insecticide and the fungicide in the polyisocyanate to form the binder resin. As discussed above, the insecticide may be dissolved in the polar solvent capable of dissolving at least 10 grams of the insecticide per one liter of the polar solvent to form the insecticide solution, which is then mixed with the polyisocyanate to form the binder resin. The insecticide is added in an amount of from 1 to 500 parts per million (PPM) based on dry weight of the lignocellulosic particles, preferably from 10 to 300, and most preferably from 20 to 250 parts per million based on dry weight of the lignocellulosic particles. The polyisocyanate is present in an amount of from 0.5 to 25 parts by weight based on 100 parts by dry weight of the lignocellulosic material.

After the binder resin is formed, the lignocellulosic mixture is formed by combining from about 75 to 99.5 parts by weight of the lignocellulosic particles based on 100 parts by weight of the lignocellulosic mixture with the binder resin in an amount of from 0.5 to 25 parts by weight based on 100 parts by weight of the lignocellulosic mixture. The lignocellulosic particles are resinated using the binder resin described above. The binder resin and the lignocellulosic particles are mixed or milled together during the formation of a resinated lignocellulosic mixture. Generally, the binder resin can be sprayed onto the particles while they are being agitated in suitable equipment. To maximize coverage of the particles, the binder resin is preferably applied by spraying droplets of the binder resin onto the particles as they are being tumbled in a rotary blender or similar apparatus. For example, the particles can be resinated in a rotary drum blender equipped with at least one spinning disk atomizer.

For testing on a lab scale, a simpler apparatus can suffice to resinate the particles. For example, a 5 gallon can is provided with baffles around the interior sides, and a lid with a hole large enough to receive the nozzle of a spray gun or other liquid delivery system, such as a pump sprayer. It is preferred that the binder resin be delivered as a spray. The particles to be resinated are placed in a small rotary blender. The blender is rotated to tumble the particles inside against the baffles, while the desired amount of binder resin is delivered with a spray device. After the desired amount of binder resin is delivered, the particles can be tumbled for a further time to effect the desired mixing of the particles with the binder resin.

The amount of binder resin to be mixed with the lignocellulosic particles in the resinating step is dependant upon several variables including, the binder resin used, the size, moisture content and type of particles used, the intended use of the product, and the desired properties of the product. The mixture produced during the resinating step is referred to in the art as a furnish. The resulting furnish, i.e., the mixture of flakes, binder resin, parting agent, and optionally, wax, wood preservatives and/or other additives, is formed into a single or multi-layered mat that is compressed into a particle board or flakeboard panel or another composite article of the desired shape and dimensions. The mat can be formed in any suitable manner. For example, the furnish can be deposited on a plate-like carriage carried on an endless belt or conveyor from one or more hoppers spaced above the belt. When a multi-layer mat is formed, a plurality of hoppers are used with each having a dispensing or forming head extending across the width of the carriage for successively depositing a separate layer of the furnish as the carriage is moved between the forming heads.

The lignocellulosic composite material may be formed of a single mat, or layer, having a thickness of from 0.1 inches to 2 feet with the insecticide and/or the fungicide dispersed throughout the layer, or formed of a plurality of mats, or layers, with each of the plurality of layers having a thickness of from 0.1 inches to 6 inches with the insecticide and/or the fungicide dispersed throughout each of the plurality of layers. The mat thickness will vary depending upon such factors as the size and shape of the wood flakes, the particular technique used in forming the mat, the desired thickness and density of the final product and the pressure used during the press cycle. The mat thickness usually is about 5 to 20 times the final thickness of the article. For example, for flakeboard or particle board panels of ½ to ¾ inch thickness and a final density of about 35 lbs/ft$^3$, the mat usually will be about 0.1 to 6 inches thick.

Finally, the lignocellulosic composite material is formed by compressing the lignocellulosic mixture at an elevated temperature and under pressure. Press temperatures, pressures and times vary widely depending upon the shape, thickness and the desired density of the composite article, the size and type of wood flakes, the moisture content of the wood flakes, and the specific binder used. The press temperature can be from about 100° to 300° C. To minimize generation of internal steam and the reduction of the moisture content of the final product below a desired level, the press temperature preferably is less than about 250° C. and most preferably from about 180° to about 240° C. The pressure utilized is generally from about 100 to about 1000 pounds per square inch. Preferably the press time is from 50 to 350 seconds. The press time utilized should be of sufficient duration to at least substantially cure the binder resin and to provide a composite material of the desired shape, dimension and strength. For the manufacture of flakeboard or particle board panels, the press time depends primarily upon the panel thickness of the material produced. For example, the press time is generally from about 200 to about 300 seconds for a pressed article with a ½ inch thickness.

The following examples, illustrating the formation of the lignocellulosic composite material, according to the subject invention and illustrating certain properties of the lignocellulosic composite material, as presented herein, are intended to illustrate and not limit the invention.

EXAMPLES

The following examples describe the formation of a lignocellulosic composite material by adding and reacting the following parts.

TABLE 1

| | Example 1 | | Example 2 | | Example 3 | | Example 4 | |
|---|---|---|---|---|---|---|---|---|
| | Amount, gm | Pbw | Amount, gm | Pbw | Amount, gm | Pbw | Amount, gm | Pbw |
| Binder Resin | 283.83 | 3.0 | 282.52 | 3.1 | 1182.44 | 4.8 | 1183.58 | 4.8 |
| Polyisocyanate | 282.42 | — | 282.24 | — | 1181.29 | — | 1181.29 | — |
| Insecticide | 1.41 | — | 0.28 | — | 1.15 | — | 2.29 | — |
| Lignocellulosic Particles A | 9076.38 | 97.0 | 9076.38 | 97.0 | 0.0 | 0.0 | 0.0 | 0.0 |
| Lignocellulosic Particles B | 0.0 | 0.0 | 0.0 | 0.0 | 24566.56 | 95.2 | 24425.95 | 95.2 |
| Total | 9360.21 | 100.0 | 9358.90 | 100.0 | 25749.0 | 100.0 | 25609.53 | 100.0 |

The polyisocyanate is LUPRANATE® M20SB, commercially available from BASF Corporation. The pyrazole insecticide is fipronil. The lignocellulosic particles A are a southern yellow pine mix having a moisture content of about 8.27%. The lignocellulosic particles B are Aspen particles having an average moisture content of about 6.76%.

In Examples 1 and 2, the lignocellulosic composite material was formed having a thickness of 0.437 inches with a density of about 39 lb/ft$^3$. In Example 1, 1.41 grams of fipronil were dissolved in 5.03 grams of the polar solvent to form the insecticide solution. The fipronil was present in an amount of about 150 PPM based on the dry weight of the lignocellulosic particles. In Example 2, 0.28 grams of fipronil were dissolved in 1.00 grams of the polar solvent to form the insecticide solution. The fipronil was present in an amount of about 30 PPM based on the dry weight of the lignocellulosic particles. The polar solvent was 1-methyl-2-pyrrolidinone (NMP). NMP is capable of dissolving about 289 grams of fipronil per liter of NMP.

In Examples 3 and 4, the lignocellulosic composite material was formed having a thickness of 0.719 inches with a density of about 40 lb/ft$^3$. In Example 3, 1.15 grams of fipronil were dissolved in 5 grams of the polar solvent to form the insecticide solution. The fipronil was present in an amount of about 50 PPM based on the dry weight of the lignocellulosic particles. In Example 4, 2.29 grams of fipronil were dissolved in 10 grams of the polar solvent to form the insecticide solution. The fipronil was present in an amount of about 100 PPM based on the dry weight of the lignocellulosic particles. The polar solvent in Examples 3 and 4 was 3-pentanone, which is capable of dissolving about 326 grams of fipronil per liter of 3-pentanone.

The insecticide solutions formed in each of the examples was then added to the polyisocyanate component to form the binder resin and the binder resin was then mixed with the lignocellulosic particles. The lignocellulosic particles were pressed under elevated temperature and pressure to form the composite materials. The composite materials were then tested to determine the insecticide potency based upon the number of days after treatment (DAT) with the results listed below as the mean percent knockdown or mortality at DAT.

TABLE 2

| | Example 1 | Example 2 | Example 3 | Example 4 | Control |
|---|---|---|---|---|---|
| | | Eastern Subterranean Termite | | | |
| 1 DAT | 51.1 | 7.7 | 0.0 | 4.9 | 1.1 |
| 2 DAT | 75.0 | 44.0 | 16.1 | 46.2 | 1.1 |
| 3 DAT | 89.8 | 82.4 | 74.1 | 79.2 | 1.1 |
| 4 DAT | 95.5 | 98.9 | 93.9 | 89.4 | 1.7 |
| 5 DAT | 96.6 | 100.0 | 90.9 | 95.8 | 1.7 |
| 6 DAT | 97.7 | — | 96.0 | 97.7 | 1.7 |

The insecticidal potency of pyrazole insecticide in the lignocellulosic composite material was determined against workers of the eastern subterranean termite, *Reticuliterme flavipes*. The control was an ordinary, untreated oriented strand board. Petri dishes were used as containers for termite assay. Each Petri dish was set up with a thin layer of moistened sand. Two corners (triangle with 15×15×20 mm) of a composite material were placed directly onto the sand. Thirty termites were placed into the dishes, the lid replaced, covered with blotter paper, and then held in an incubator (25° C.). Data was collected at specified days after treatment listed above recording knocked down, or dead termites, and intoxicated termites.

In Examples 1-4, the mean percent mortality of termites approached 100 percent, whereas the Control only reached a mean percent mortality of 3.3 percent. It is to be appreciated that these results were observed only over a short period of time, whereas in practice, the composite material will be exposed for longer period of times. Therefore, the results for the treated composite material will provide a greater insecticide resistance over time relative to the Control.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A lignocellulosic composite material comprising:

lignocellulosic particles in an amount of from about 75 to 99.5 parts by dry weight based on 100 parts by weight of said composite material; and a binder resin in an amount of from 0.5 to 25 parts by weight based on 100 parts by weight of said composite material, said binder resin comprising;

a polyisocyanate and at least one of an insecticide and a fungicide dispersed throughout said polyisocyanate and dispersed throughout said lignocellulosic particles, wherein said insecticide is present in an amount of from 1 to 500 parts per million based on the dry weight of said lignocellulosic particles and said fungicide is present in an amount of from 1 to 500 parts per million based on the dry weight of said lignocellulosic particles.

2. A composite material as set forth in claim 1 wherein said insecticide is selected from at least one of the following: pyrazole insecticides, pyrrole insecticides, pyrethroid insecticides, amidinohydrazone insecticides, semicarbazone insecticides, and neo-nicotinoid insecticides.

3. A composite material as set forth in claim 1 wherein said fungicide is selected from at least one of the following families: triazoles, benzimidazoles, morpholines, dicarboxamides, and strobilurines.

4. A composite material as set forth in claim 2 wherein said pyrethroid insecticide is of the general formula:

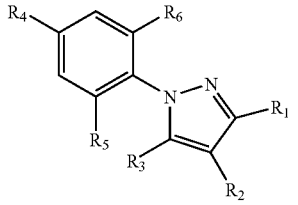

wherein RI is one of CN and methyl,

R2 is S(O)r,A, wherein A is a haloaklyl and n is 0, 1, or 2,

R3 is one of H, NH2, and alkyl,

R4 is an haloaklyl,

R5 is a halogen, and

R6 is a halogen.

5. A composite material as set forth in claim 2 wherein said pyrazole insecticide is 5-amino-1-(2,6-dichloro-4-(trifluoromethyl)phenyl)-4-((trifluoro methyl)sulfiny1)-1H-pyrazole-3-carbonitrile.

6. A composite material as set forth in claim 1 wherein said polyisocyanate is selected from at least one of diphenylmethane diisocyanate and toluene diisocyanate.

7. A composite material as set forth in claim 1 wherein said insecticide is present in an amount of from 10 to 300 parts per million based on the dry weight of said lignocellulosic particles.

8. A composite material as set forth in claim 1 wherein said insecticide is present in an amount of from 20 to 250 parts per million based on dry weight of said lignocellulosic particles.

9. A composite material as set forth in claim 1 wherein said polyisocyanate is present in an amount of from 0.5 to 25 parts by weight based on 100 parts by dry weight of said lignocellulosic material.

10. A composite material as set forth in claim 1 further comprising a single layer having a thickness of from 0.1 inches to 2 feet with said pyrazole insecticide dispersed throughout said layer.

11. A composite material as set forth in claim 1 further comprising a plurality of layers with each of said plurality of layers having a thickness of from 0.1 inches to 6 inches, with said pyrazole insecticide dispersed throughout each of said plurality of layers.

12. A composite material as set forth in claim 1 wherein said at least one of said insecticide and said fungicide is dissolved in a polar solvent to form an insecticide solution.

13. A composite material as set forth in claim 12 wherein said polar solvent is capable of dissolving at least 10 grams of at least one of said insecticide and said fungicide per one liter of said polar solvent.

* * * * *